United States Patent [19]

Cook et al.

[11] Patent Number: 4,622,791

[45] Date of Patent: Nov. 18, 1986

[54] BASE MOLDING

[75] Inventors: Melvin W. Cook, Dover; Carl J. Schmidt, Alliance, both of Ohio

[73] Assignee: Masonite Corporation, Chicago, Ill.

[21] Appl. No.: 714,365

[22] Filed: Mar. 21, 1985

[51] Int. Cl.[4] ..... E04B 2/74

[52] U.S. Cl. ..... 52/241; 52/287

[58] Field of Search ..... 52/242, 241, 238, 277, 52/278, 287, 288, 716, 828, 730

[56] References Cited

U.S. PATENT DOCUMENTS

| | | | |
|---|---|---|---|
| 1,205,358 | 11/1916 | Knapp | 52/277 |
| 1,250,594 | 12/1917 | Knapp | 52/287 |
| 1,453,072 | 4/1923 | Knapp | 52/287 |
| 1,981,239 | 11/1934 | Manske | 52/716 |
| 2,029,549 | 2/1936 | Winterich | 52/287 |
| 2,951,566 | 9/1960 | Armenti | 52/731 |
| 3,353,301 | 11/1967 | Heilweil | 52/731 |
| 3,368,312 | 2/1968 | Shore | 52/241 |
| 3,956,861 | 5/1976 | Rausmussen | 52/241 |
| 3,994,105 | 11/1976 | Jamison | 52/731 |
| 4,068,432 | 1/1978 | Davis | 52/241 |
| 4,430,832 | 2/1984 | Kaiser | 52/242 |

FOREIGN PATENT DOCUMENTS

| | | | |
|---|---|---|---|
| 2110312 | 9/1972 | Fed. Rep. of Germany | 52/288 |
| 1317930 | 1/1963 | France | 52/287 |
| 1421484 | 1/1976 | United Kingdom | 52/287 |

*Primary Examiner*—John E. Murtagh

*Attorney, Agent, or Firm*—Samuel Kurlandsky; Robert M. Didrick; Robert H. Robinson

[57] ABSTRACT

An integral base molding adapted to be mounted at the base of a wall, and having a front wall member, a rear wall member and a panel-supporting web positioned above the bottom of the base molding, defining a channel adapted to receive the lower edges of panels and to support the panels at a position above ground level. Additionally, means are provided to facilitate mounting of the base molding at inner or outer room corners.

10 Claims, 7 Drawing Figures

BASE MOLDING

BACKGROUND OF THE INVENTION

1. Field of the Invention

The present invention relates to building construction, and more particularly concerns a base molding adapted to be mounted on studs, furring strips or a structural wall, and when so mounted receives the ends of panels and supports them in a position elevated above the floor on which the base molding is mounted.

2. Description of the Prior Art

Wall panels are generally mounted against a support with their lower edges supported by the floor of the room in which the panels are mounted. When so mounted the panels are subject to attack by moisture and other contaminants which may seep behind or into the wall panels at the floor level. The panels are generally mounted with grout or other materials which may attract dirt.

SUMMARY OF THE INVENTION

It is an object of the invention to provide a base molding for panel wall construction which is attractive and relatively inexpensive to produce.

It is a further object of the invention to provide a base molding which may be fabricated by such methods as extrusion.

It is a further object of the invention to provide a base molding which receives and supports wall panels at a distance elevated above the floor level, and which permits the edges of the panels to be sealed within channels provided in the base molding.

Other objects and advantages of the invention will bcome apparent from reference to the following description and accompanying drawings.

According to the invention, a base molding is provided having means for being mounted on wall supports, and which has a channel provided for receiving the lower edges of the panels constituting the wall and maintaining the lower edges of the panels in a position elevated above the surface of the floor on which the structure is mounted. Additionally, an adhesive, cement or sealant may be utilized to seal the edges of the panels within the channel of the base molding.

DESCRIPTION OF THE PREFERRED EMBODIMENTS

Figure 1:
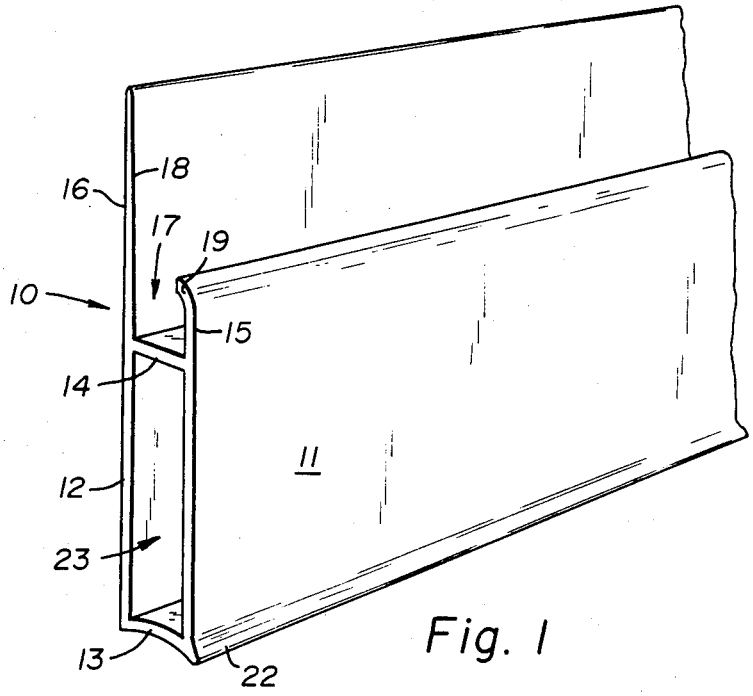
FIG. 1 is a perspective view of a base molding according to the invention.
Figure 2:
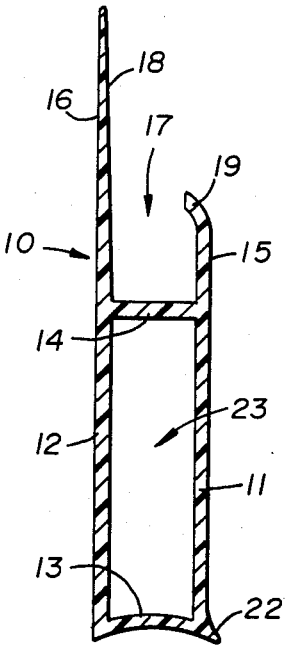
FIG. 2 is a cross-sectional view taken at the line 2—2 of FIG. 1.

Referring to FIGS. 1 and 2 a base molding 10 is shown which has been formed by extrusion from a suitable plastic material, having a front wall 11 and a rear wall 12. A bottom wall 13 is provided which is integral with the front wall 11 and rear wall 12, and serves to maintain the walls in fixed spaced-apart relationship. A panel support web 14 is integrally formed and also maintains the front wall 11 and rear wall 12 in fixed spaced-apart relationship. A face flange 15 extends from the front wall 11 above the panel support web 14 as an integral part of the front wall 11. A back nailing flange 16 extends as an integral back of the rear wall 12 above the panel support web.

Figure 3:
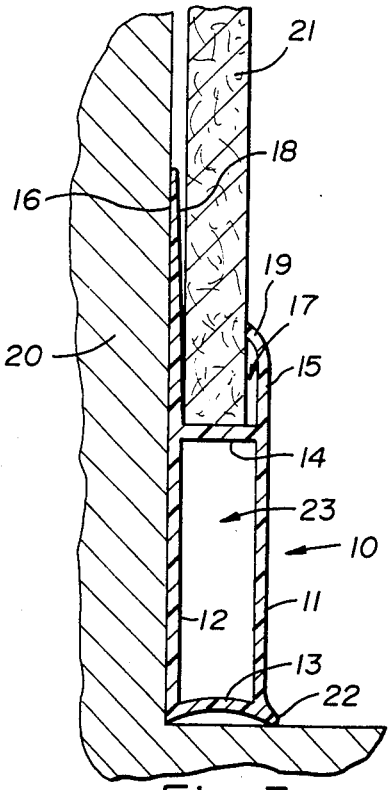
FIG. 3 is a cross-sectional view showing a panel inserted into the channel of the base molding.
Figure 4:
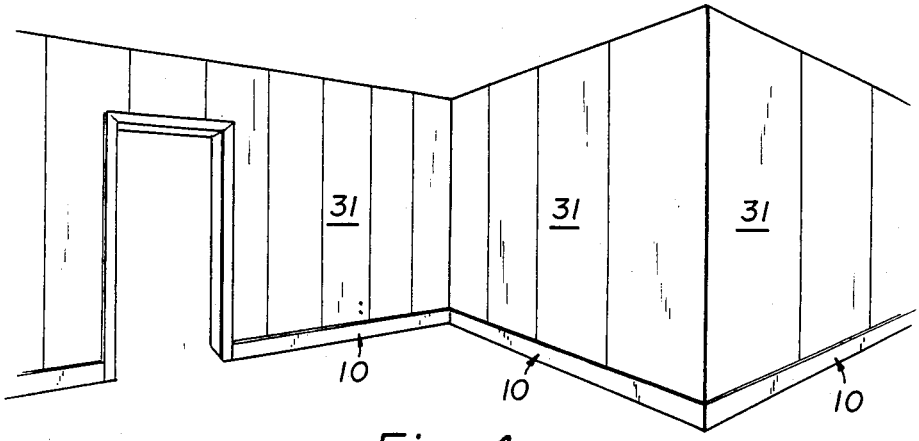
FIG. 4 is a perspective view of a wall showing panels mounted in a base molding according to the invention, with both inside and outside corners shown.
Figure 5:
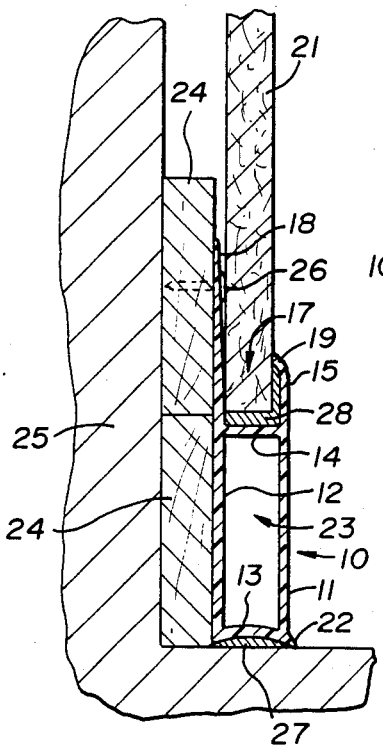
FIG. 5 is a cross-sectional view showing the base molding of the present invention affixed to a wall structure and having the lower edge of a panel inserted into the channel of the base molding.

The face flange 15, the panel support web 14, and the back nailing flange 16 cooperate to define a channel 17 for receiving the edges of a plurality of panels 21 which are mounted on the base molding to form a wall, as shown in FIGS. 3, 4 and 5. The front wall 11, the rear wall 12, the bottom wall 13 and the panel support web 14 cooperate to define a rectangular tubular chamber 23 adapted to receive channel members of the corner supporting structures. The back nailing flange 16 is provided with a beveled lip 18 to facilitate entry of a panel into the channel 17. The face flange 15 is provided with an in-turned lip 19 for engaging the outer face of the panel 21. The bottom wall 13 may be formed with its outer face concave to retain an adhesive sealant 27 to to seal the base 10 to the floor. The bottom wall 13 may also be provided with a toe 22 to engage the floor.

As shown in FIG. 5, in utilizing the base molding of the present invention for erection of a wall, the molding 10 is placed against studs 24 or furring strips which are mounted on a supporting wall structure 25. The base molding 10 is affixed to the studs 24 or furring strips by nails 26 or screws penetrating the back nailing flange 16. A plurality of panels 21 are then inserted into the channels 17 and sealed therein by applying a sealant compound or adhesive 28, as shown in FIG. 5. The upper portions of the panels are then affixed to the studs or furring strips in conventional manner by nails, screws or adhesives.

Referring to FIG. 4, a paneled wall 31 is shown having a plurality of panels 21 mounted in the base molding 10 and maintained in a position wherein the lower edges of the panels are elevated about the floor.

Figure 6:
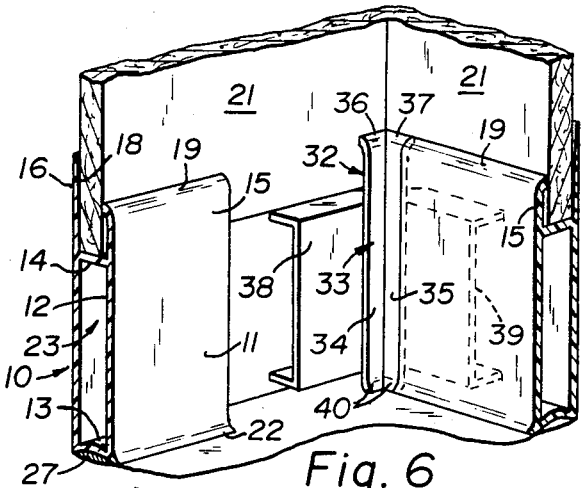
FIG. 6 is a perspective view of an inside corner structure utilizing base moldings according to the invention.

Referring to FIG. 6, an inner corner section of a room structure is shown utilizing base moldings 10 supporting a plurality of panels 21. The base members 10 are supported at the room corner by an inner corner base molding support 32. The support 32 comprises a vertical angle member 33 formed of flanges 34 and 35. The upper ends of the flanges 34 and 35 are provided with curved ends 36 and 37 to match the contours of the in-turned lip 19. Channel members 38 and 39 are affixed to the outer surfaces of the flanges of said angle member 33. The entire corner support 32 is fastened together by means of an adhesive, nails or screws to form an integral structure. The channel members 38 and 39 are arranged to be inserted into the tubular chamber 23 of the base molding 10.

Figure 7:
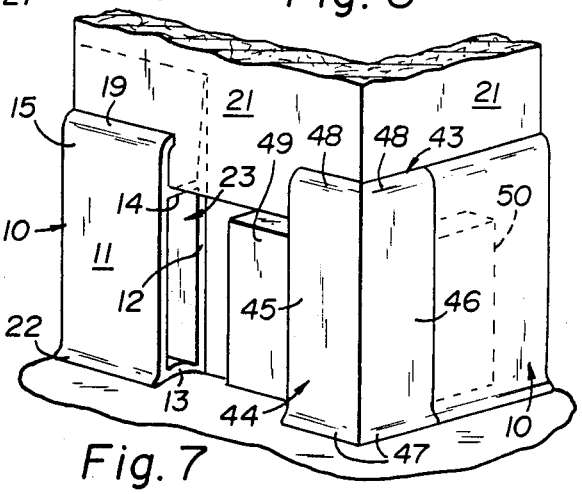
FIG. 7 is a perspective view of an outside corner structure utilizing base moldings according to the invention.

Referring to FIG. 7, an outer corner structure of a room wall is shown. An outer corner base molding support 43 is shown comprising an angle member 44 having flanges 45 and 46. The angle member 44 is provided with toes 47 and rounded upper edges to blend with the toes 22 and in-turned lip 19 of the base molding 10. Channels 49 and 50 are affixed to the inner surfaces of said angle member 44 and provided to be received into the chamber 23 for engaging the base molding. The entire outer corner base molding support 43 is formed as an integral structure by means of an adhesive, nails, or screws.

The structure of the present invention has several advantages over prior art structures. The base molding seals the wall panels against moisture and protect the wall substrate. It provides firm support for the wall panels in a position wherein the lower edges of the panels are elevated above the floor level to prevent their becoming contaminated with moisture and other contaminants that may be present on the floor or in the materials used to form the wall. The base molding may be manufactured from mechanically strong plastic compositions such as polyvinyl chloride. The molding offers an attractive, highly professional finished appearance in the installation. The base molding is easy to install, relatively simple to maintain, and sufficiently durable to maintain its attractive appearance in high-traffic commercial environment. It is resistant to impact, crack, scratch and mars. In commercial form the base molding is a one-piece PVC extrusion with $\frac{1}{8}''$ thick walls. The face is 3 3/16″ high while the back nailing flange is formed at a width of 5 $\frac{1}{2}''$. The channel 17 beween the face and back flanges is formed at a dimension of $\frac{3}{4}''$ in width, and 1″ deep. As a result, the panel bottom is held 2 $\frac{5}{8}''$ above floor level. The base moldings are commercially available in 10′ lengths.

During installation of the panels, a $\frac{1}{4}''$ bead of a silicone sealant 23 may be applied to the bottom of the base molding. In erecting the structure, the base molding is placed in position, with the back flange resting flush against the vertical surface of the studs or furring strips. Nails, preferably of a size no larger than #6 common are driven through the back flange into the studs or furring strips. A $\frac{1}{2}''$ bead of silicone sealant 22 is then introduced into the channel 17. This prevents moisture from seeping into the panel core. The excess sealant is then wiped clean. Panels are placed into the channel of the base molding, and the installation is then completed in normal fashion.

In forming corner structures such as shown in FIGS. 7 and 7, the moldings should be preferably mitered and fitted snugly together. Two joined pieces along a horizontal wall should be butted together. Sealant is then applied to adjoining edges prior to installation to form an excellent moisture-resistant installation.

While the present invention has been disclosed and described and shown in the light of the specific embodiments thereof, it is evident many alternatives, modifications, and variations may be readily apparent to one skilled in the art in the light of the foregoing disclosure as contained in the specification and drawings. Accordingly, the disclosure is intended to embrace all such alternatives, modifications and variations as may fall within the spirit and scope of the invention as defined in the following appended claims.

Invention is claimed as follows:

1. A base molding adapted to be mounted against a vertical wall structure at or near a floor to receive and engage one or more wall panels each having lower edges and to support said wall panel lower edges at a position elevated above the level of said floor, said base molding comprising an integral unitary structure formed by extruding a plastic material and comprising:

a rear wall having a lower end, a front wall having a lower end, a bottom wall connecting the lower end of said front wall and the lower end of said rear wall in spaced-apart relationship, the outer surface of said bottom wall being concave and terminating in a toe at the junction of said bottom wall and said front wall and adapted to receive a sealant for sealing said base molding to said floor, a panel support web connecting said front and rear walls at a position spaced from said bottom, a back nailing flange extending as an integral portion of said rear wall above its connection with said panel support web, and a face flange extending from said front wall as an integral portion thereof and above said panel support web, said back nailing flange, said panel support web, and said face flange cooperating to define a channel adapted to receive the lower edge of a wall panel and to support said panel at a position elevated above said floor.

2. A base molding according to claim 1, wherein said inner surface of said back nailing flange is recessed to facilitate insertion of a panel into said channel.

3. A base molding according to claim 1, wherein said front face flange terminates in a lip curved to have its edge engage the surface of a panel placed in said channel.

4. A wall comprising:

a supporting wall structure, a base molding affixed to said wall structure at or near a floor, said base molding comprising an integral unitary structure formed by extruding a plastic material and comprising:

a rear wall having a lower end, a front wall having a lower end, a bottom wall connecting the lower end of said front wall and the lower end of said rear wall in spaced-apart relationship, the outer surface of said bottom wall being concave and terminating in a toe at the junction of said bottom wall and said front wall and having sealant sealing said base molding to said floor, a panel support web connecting said front and rear walls at a position spaced from said bottom, a back nailing flange extending as an integral portion of said rear wall above its connection with said panel support web, and a face flange extending from said front wall as an integral portion thereof and above said panel support web, said back nailing flange, said panel support web, and said face flange cooperating to define a channel, a plurality of wall panels each having its lower edge engaged in said channel, and means fastening said back nailing flanges to said supporting structure.

5. A wall according to claim 6, wherein the inner surface of said back nailing flange is recessed to facilitate insertion of a panel into said channel.

6. A wall according to claim 5, wherein said front face flange terminates in a lip curved to have its edge engage the surface of a panel placed in said channel.

7. An inner wall corner structure comprising:

A. an inner corner support comprising:

1. a vertical angle member comprising a pair of perpendicularly oriented flanges having inner and outer surfaces,
2. a pair of channel members in perpendicular relationship one affixed to the outer surface of each of the flanges of said vertical angle member, B. a plurality of base moldings arranged end-to-end each comprising an integral unitary structure formed by extruding a plastic material and comprising:
1. a rear wall having a lower end,
2. a front wall having a lower end,
3. a bottom wall connecting the lower end of said front wall and the lower end of said rear wall in spaced-apart relationship, the outer surface of said bottom wall being concave and terminating in a toe at the junction of said bottom wall and said front wall, and having a sealant sealing said base molding to said floor,
4. a panel support web connecting said front and said rear walls at a position spaced from said bottom
5. a back nailing flange extending as an integral portion of said rear wall above its connection with said panel support web, and
6. a face flange extending from said front wall as an integral portion thereof and above said panel support web, said back nailing flange, said panel support web, and said face flange cooperating to define a channel adapted to receive the lower edge of a wall panel and to support said panel at a position elevated above said floor, said rear wall, said front wall, said bottom wall, and said panel support web cooperating to define a rectangular tubular chamer, the channel members of said corner support being disposed within the tubular chambers of said base moldings, C. a wall support having the back nailing flanges of said base moldings affixed thereto, and D. a plurality of panels having lower edges, said lower edges being disposed and retained within the channels of said base moldings.

8. An inner wall corner structure, according to claim 7, wherein the front face flange of said base molding terminates in a lip curved to have its edge engage the surface of a panel positioned in said channel, wherein the ends of the flanges at the upper portion of said vertical angle member are contoured to match the edges of the curved lip of said front face flange, and wherein the edges of the flanges of the lower portion of said angle member are contoured to match said toe of said bottom wall.

9. An outer wall corner structure comprising:

A. an inner corner support comprising:
1. a vertical angle member comprising a pair of perpendicularly oriented flanges having inner and outer surfaces,
2. a pair of channel members in perpendicular relationship one affixed to the inner surface of each of the flanges of said vertical angle member, B. a plurality of base moldings arranged end-to-end each comprising an integral unitary structure formed by extruding a plastic material and comprising:
1. a rear wall having a lower end,
2. a front wall having a lower end,
3. a bottom wall connecting the lower end of said front wall and the lower end of said rear wall in spacedapart relationship, the outer surface of said bottom wall being concave and terminating in a toe at the junction of said bottom wall and said front wall, and having a sealant sealing said base molding to said floor,
4. a panel support web connecting said front and said rear walls at a position spaced from said bottom,
5. a back nailing flange extending as an integral portion of said rear wall above its connection with said panel support web, and
6. a face flange extending from said front wall as an integral portion thereof and above said panel support web, said back nailing flange, said panel support web, and said face flange cooperating to define a channel adapted to receive the lower edge of a wall panel and to support said panel at a position elevated above said floor, said rear wall, said front wall, said bottom wall, and said panel support web cooperating to define a rectangular tubular chamber, the channel members of said corner support being disposed within the tubular chambers of said base moldings, C. a wall support having the back nailing flanges of said base moldings affixed thereto, and D. a plurality of panels having lower edges, said lower edges being disposed and retained within the channels of said base moldings.

10. An outer wall corner structure, according to claim 9, wherein the outer surface of said bottom wall terminates in a toe, the front face flange of said base molding terminates in a lip curved to have its edge engage the surface of a panel positioned in said channel, wherein the ends of the flanges at the upper portion of said vertical angle member are contoured to match the edges of the curved lip of said front face flange, and wherein the edges of the flanges of the lower portion of said angle member are contoured to match said toe.

* * * * *

UNITED STATES PATENT AND TRADEMARK OFFICE

CERTIFICATE OF CORRECTION

PATENT NO. : 4,622,791

DATED : November 18, 1986

INVENTOR(S) : Melvin W. Cook et al

It is certified that error appears in the above—identified patent and that said Letters Patent is hereby corrected as shown below:

IN THE CLAIMS:

Claim 5, line 1, change "6" to --4--.

Claim 10, line 54, after the word "toe" insert --of said bottom wall--.

Signed and Sealed this

Seventeenth Day of March, 1987

*Attest:*

DONALD J. QUIGG

*Attesting Officer*

*Commissioner of Patents and Trademarks*